US006460475B1

(12) United States Patent
Yang

(10) Patent No.: US 6,460,475 B1
(45) Date of Patent: Oct. 8, 2002

(54) METHOD AND DEVICE FOR MANUFACTURING STRING CORE-FREE INVISIBLE ZIPPER

(76) Inventor: Chin-Shui Yang, 5F, No. 3, Lane 32, Sec. 2, Feng-Nien Rd., Taipei (TW)

( * ) Notice: Subject to any disclaimer, the term of this patent is extended or adjusted under 35 U.S.C. 154(b) by 0 days.

(21) Appl. No.: 09/903,532

(22) Filed: Jul. 13, 2001

(30) Foreign Application Priority Data

Aug. 16, 2000 (TW) ..... 89116511 A

(51) Int. Cl.[7] ..... D05B 23/00; D05B 35/06
(52) U.S. Cl. ..... 112/475.16
(58) Field of Search ..... 112/475.16, 260, 112/475.14, 152, 104; 29/766, 769

(56) References Cited

U.S. PATENT DOCUMENTS 3,685,474 A * 8/1972 Frohlich et al.
3,750,605 A * 8/1973 Warburton et al.
4,441,438 A * 4/1984 Takahashi ..... 112/470.33
6,286,446 B1 * 9/2001 Lee ..... 112/470.33

* cited by examiner

*Primary Examiner*—Ismael Izaguirre
(74) *Attorney, Agent, or Firm*—Troxell Law Office PLLC

(57) ABSTRACT

Method and device for manufacturing string core-free invisible zipper. Without string core, the molded zipper racks are separately and directly loosely reversely fed into the needle seat of the machine. The fabric belts are at the same time fed into the needle seat for sewing the zipper racks thereon. Prior to feeding the racks into the needle seat, it is not necessary to use a rack separating bar to forcedly stretch open the two racks. Accordingly, the zipper racks are prevented from being tensioned and deformed or curled and the pitch will be unified. The slider can more smoothly slide without being obstructed. The teeth of the racks can more firmly mesh with each other.

3 Claims, 6 Drawing Sheets

METHOD AND DEVICE FOR MANUFACTURING STRING CORE-FREE INVISIBLE ZIPPER

BACKGROUND OF THE INVENTION

The present invention is related to a method and a device for manufacturing string core-free invisible zipper. By means of the method and the device, the zipper racks can be totally independently and naturally loosely fed into the needle seat and sewn on the fabric belts. It is not necessary to first forcedly stretch open the two racks prior to feeding the racks into the needle seat. Accordingly, the zipper racks are prevented from being tensioned and deformed or curled and the pitch will be unified and the racks can be precisely sewn on the fabric belts.

A zipper is applied to a clothes or a purse for quickly putting on or taking off the clothes. A conventional zipper includes a pair of fabric belts and zipper racks sewn on opposite lengthwise edges of the fabric belts and a slider slidable along the edges for zipping on/off the zipper. The zipper teeth of a traditional zipper are exposed between the two fabric belts so that the appearance is poor. An invisible zipper has been developed. The connecting sections of the zipper teeth are hidden in the reversely folded edges of the fabric belts so as to achieve better appearance.

In the conventional invisible zipper, the zipper rack is made in such a manner that a zipper wire material is spiraled or wound and drawn on a thread rod. During drawing, the wire is heated and molded. After molded, the zipper rack needs to overcome the twisting and deformation after cooled. Therefore, after molded, the slider is used to force the two independent zipper racks to mesh with each other and then curl and collect. Due to the drawing, even though the zipper racks are engaged with each other, the pitch will be still ununified and the zipper rack will bend and tangle. Therefore, a reinforcing string core is passed through the loops of the zipper for pulling and retaining the zipper rack so as to avoid twisting and deformation thereof. However, when feeding the zipper rack and fabric belt into the needle disc of the machine for sewing, the two lateral racks must be separately reversely fed in and sewn on the fabric belts. After sewn, the slider is used to zipper on the racks. Therefore, prior to feeding into the needle disc, in a conventional zipper making machine, a zipper rack separating bar 7 is disposed in front of the entrance of the needle disc for forcedly separating the zipper racks. Then, the racks 6 are intersectionally reversely fed into the needle seat 5 of the machine (referring to FIG. 7). In addition, in order to overcome the curling of the racks 6 which cannot be placed straight into the needle seat 5 for sewing, inward flanges 511 are disposed at top end of the guiding channel 51 of the needle seat 5, whereby when guiding in the racks 6, the flanges press and hold the racks 6 and prevent the racks 6 from bending up and separating from the channel 51 to interrupt the operation. The guiding gap 51A of the needle seat 5 at the sewing board 52 is smaller than the gap of the front section of the guiding channel 51. Accordingly, when feeding in the racks, the racks will be deflected and damped. This makes it difficult to sew and locate the racks. Moreover, prior to feeding the racks into the needle seat 5, the separating bar 7 will separate the engaged racks 6. Accordingly, the racks 6 will suffer an undesired pulling force prior to sewing operation. Under the double additional pulling force, the pitch of the racks 6 will be changed and ununified. After sewn, the racks on two sides can hardly precisely mesh with each other. Therefore, the zipper tends to unlatch or it will be hard to slide the slider.

SUMMARY OF THE INVENTION

It is therefore a primary object of the present invention to provide a method and a device for manufacturing string core-free invisible zipper. Without string core, the molded zipper racks are separately and directly loosely reversely fed into the needle seat of the machine. The fabric belts are at the same time fed into the needle seat for sewing the zipper racks thereon. Prior to feeding the racks into the needle seat, it is not necessary to use a rack separating bar to forcedly stretch open the two racks. Accordingly, the zipper racks are prevented from being tensioned and deformed or curled and the pitch will be unified. The slider can more smoothly slide without being obstructed. The teeth of the racks can more firmly mesh with each other.

It is a further object of the present invention to provide the above method and device in which the guiding channels of the needle seat pass through the entire needle seat and have unified width so that the racks can be fed in without being obstructed and unevenly tensioned. Therefore, the zipper racks are prevented from being tensioned and deformed and the pitch will not be deflected and can be precisely sewn on the fabric belts.

It is still a further object of the present invention to provide the above method and device in which the zipper rack itself is straight without twisting so that it is unnecessary to additionally pass a reinforcing string core through the zipper rack. Therefore, the processing procedure can be omitted and the cost for the zipper rack is reduced.

The present invention can be best understood through the following description and accompanying drawings wherein:

DETAILED DESCRIPTION OF THE PREFERRED EMBODIMENT

Figure 1:
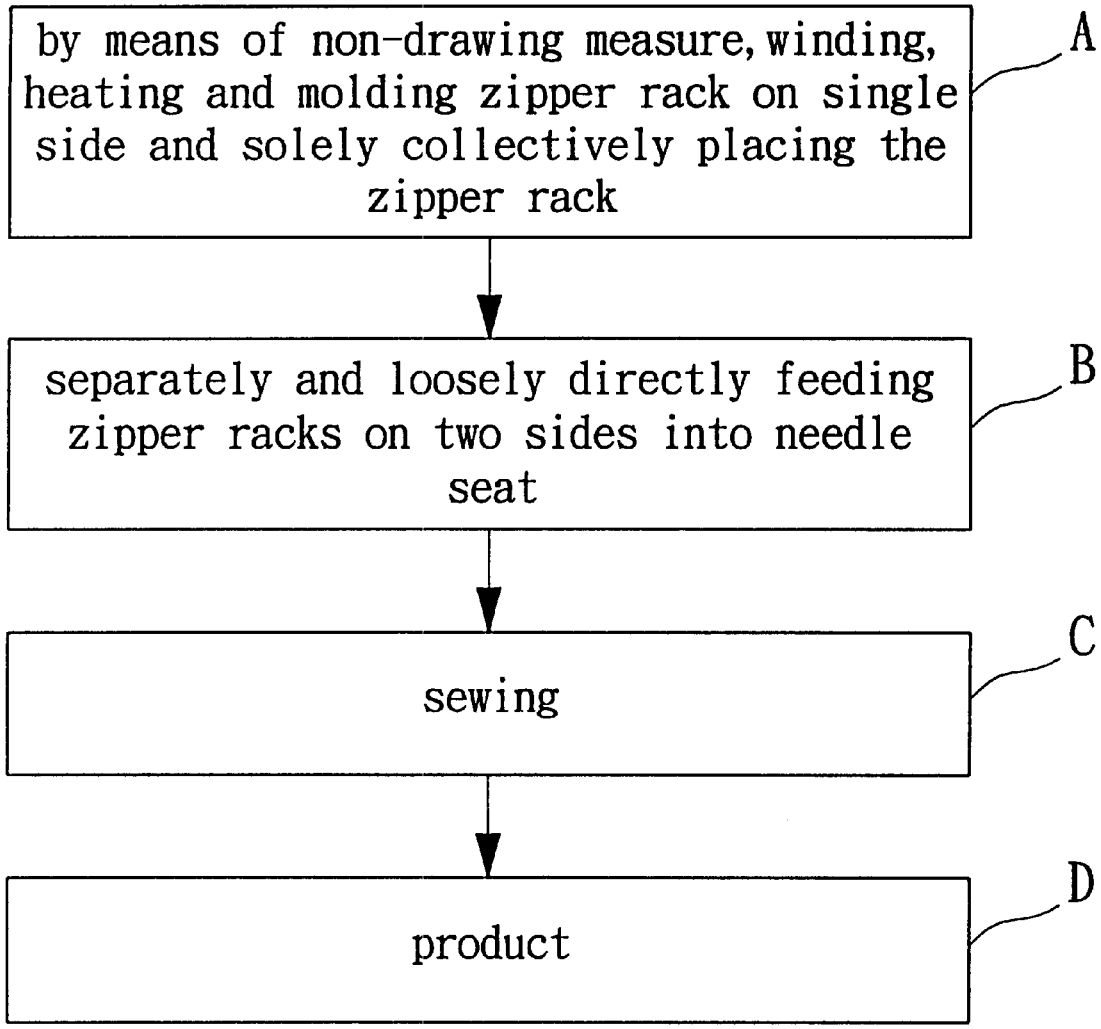
FIG. 1 is a flow chart of the method of the present invention.

Please refer to FIG. 1. The method for manufacturing string core-free invisible zipper of the present invention includes steps of:

Step A: By means of non-drawing measure, the wire material (nylon wire) of the zipper rack via a toothed disc is back and forth wound on the teeth and heated and molded. Thereafter, the zipper rack 4 on single side is directly solely collectively placed and it is not necessary to use the slider to bind the racks 4 on two sides together.

Step B: The molded zipper racks are independently freely and loosely directly placed in parallel to each other in reverse direction. The racks 4 and the fabric belts 3 are respectively fed into the needle seat 1 and the press tray 2 of the machine.

Step C: Then, at the sewing section of the needle seat 1 and the press tray 2, the zipper racks 4 are reversely lengthwise sewn on the opposite inner edges of the fabric belts 3 on two sides.

Step D: A preliminary invisible zipper product is formed. After output from the needle seat 1, the slider is used to forcedly bind the racks which is then ironed.

Figure 2:
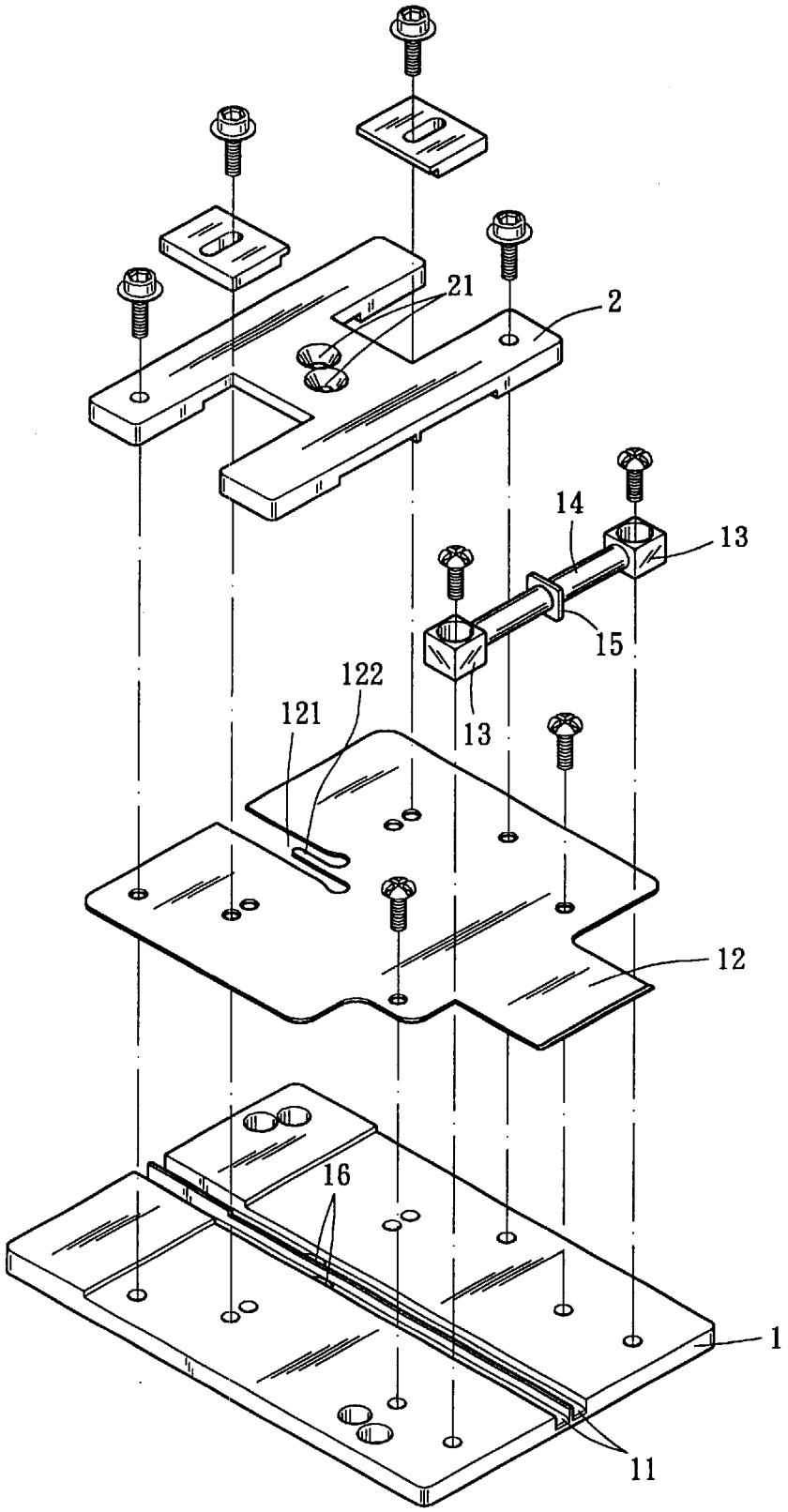
FIG. 2 is a perspective exploded view of the device of the present invention.
Figure 3:
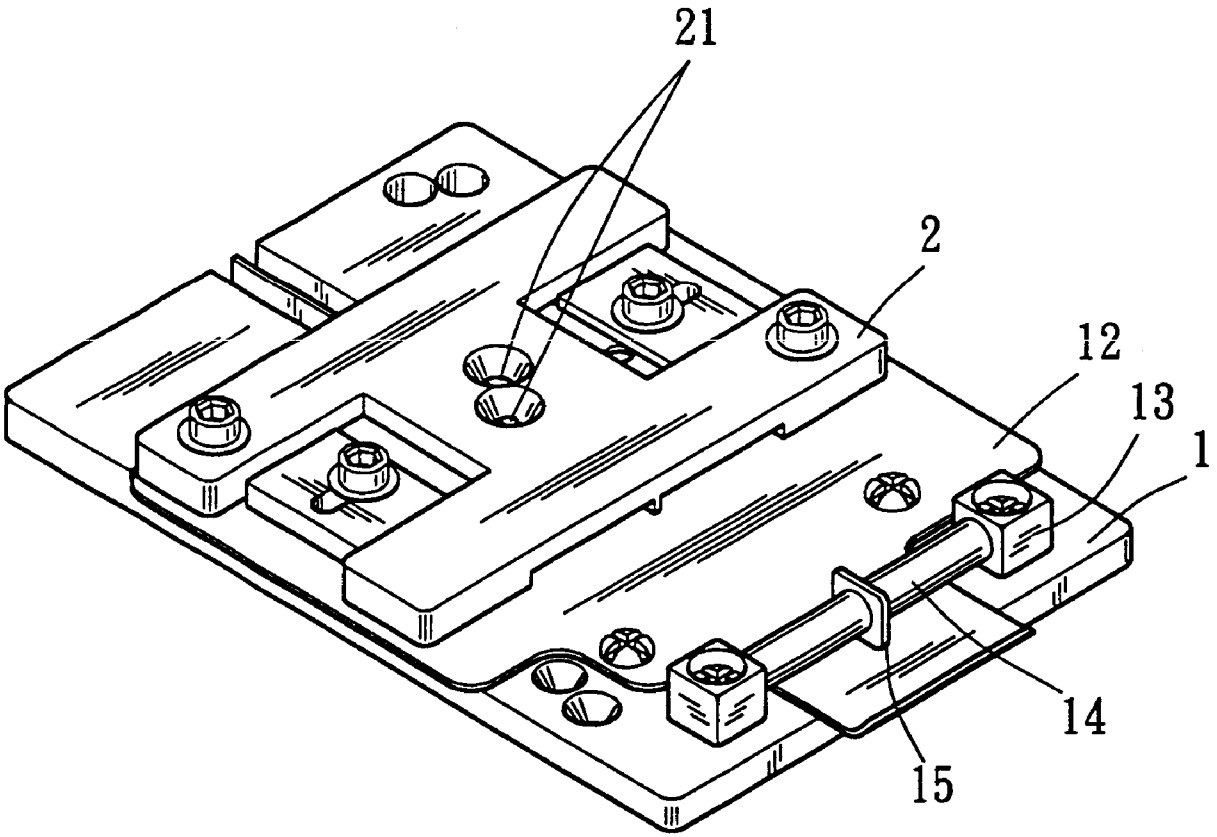
FIG. 3 is a perspective assembled view of the device of the present invention.
Figure 4:
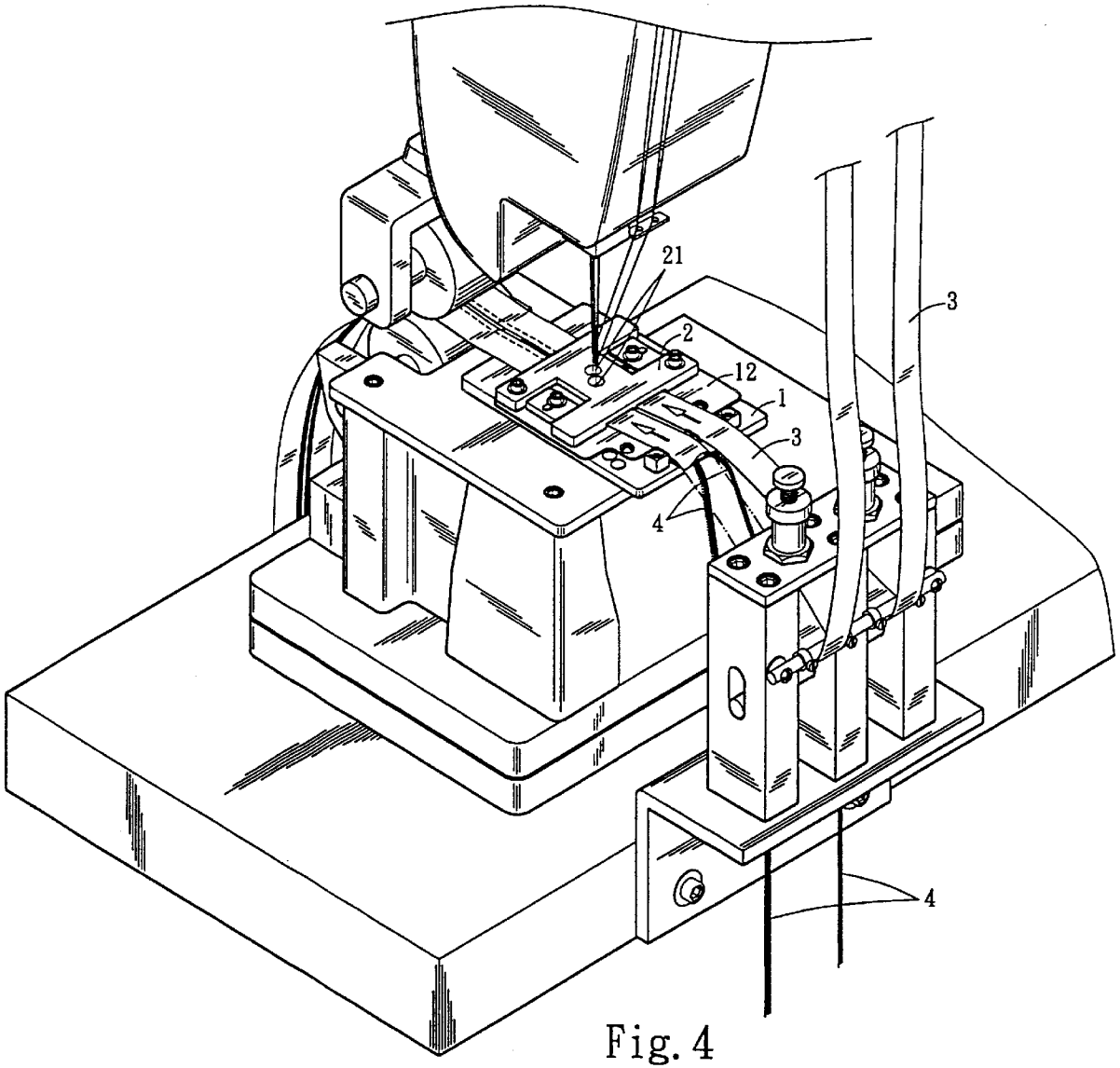
FIG. 4 is a perspective view showing the application of the device of the present invention.
Figure 5:
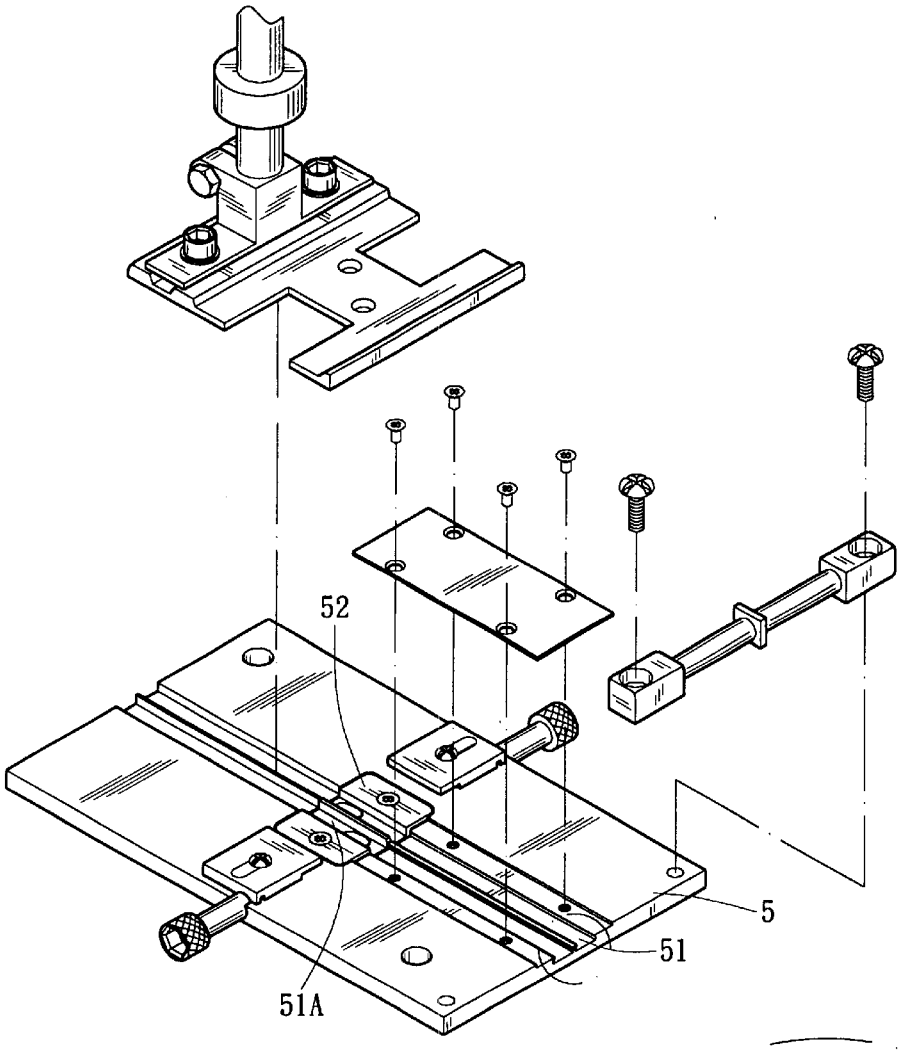
Fig. 5 (prior art)
FIG. 5 is a perspective exploded view of a conventional device for manufacturing the zipper.
Figure 6:
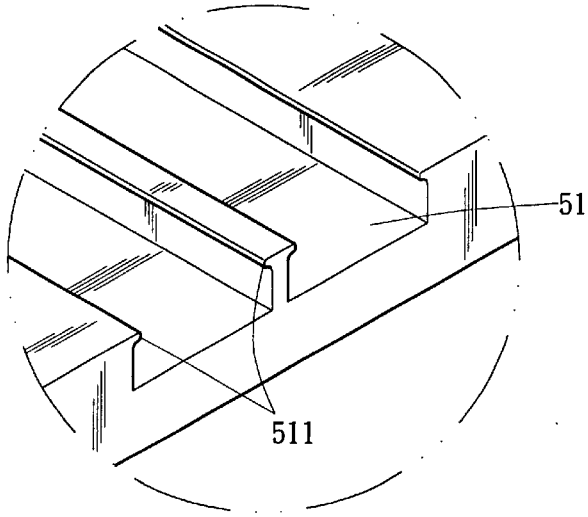
Fig. 6 (prior art)
FIG. 6 is a perspective view of the channels of the conventional device.
Figure 7:
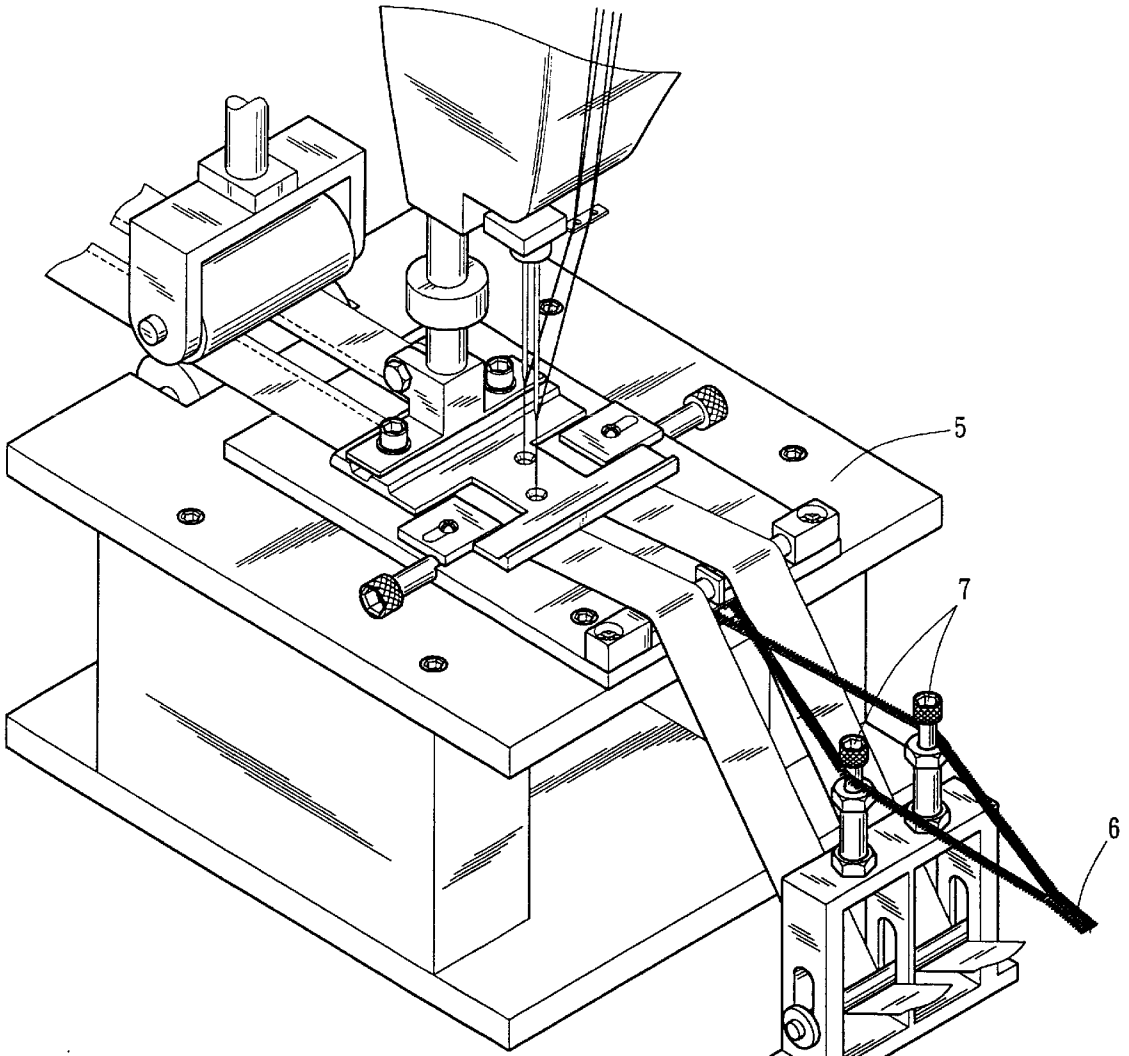
Fig. 7 (prior art)
FIG. 7 is a perspective view showing the application of the conventional device.

Please refer to FIGS. 2 and 3. The device for manufacturing string core-free invisible zipper of the present invention includes a needle seat 1 and a press tray 2 disposed on the zipper making machine. The needle seat 1 is formed with a pair of parallel guiding channels 11 passing through the needle seat 1. The zipper racks 4 are fed into and guided by the guiding channels 11. A certain positions of the channels 11 are formed with needle holes 16. A cover board 12 is disposed on upper side of the channels 11. A fixing seat 13 is disposed on front side of the needle seat 1. A transverse beam 14 is disposed on the fixing seat 13. A partitioning plate 15 is disposed at the center of the transverse beam 14 for guiding two fabric belts 3 to be separately fed in from two sides through the transverse beam 14 and input into the space between the press tray 2 and the cover board 12.

The press tray 2 presses the needle seat 1 and the cover board 12 and is formed with needle holes 21 corresponding to the needle holes 16 of the needle seat 1. A rear side of the cover board 12 is formed with a split 121 corresponding to the needle holes 16, 21. A retaining section 122 rearward extends from the split 121 between the needle holes 16, 21.

During the winding and molding procedure A of the zipper rack 4, the rack 4 is not drawn so that the rack 4 can be naturally placed without curling and the pitch is kept constant. Therefore, it is unnecessary to pass an auxiliary string core through the rack. Also, it is unnecessary to bind the two racks and input and sew them together for keeping unified pitch. Accordingly, when the racks 4 are input into the zipper making machine 10, the racks 4 can be totally independently and naturally loosely fed into the needle seat 1 in parallel to and reverse to each other for sewing. It is not necessary to first use the separating bar to forcedly stretch open the two racks in front of the entrance as in conventional machine. Accordingly, when the racks 4 and the fabric belts 3 get into the space between the needle seat 1 and the cover board 12, they can be sewn in a totally loosened state without being pulled and extended. The pitch will be thus unified and the power for conveying is reduced and the manufacturing can be speeded. The channels 11 of the needle seat 1 only serve to guide the racks 4 so that the racks can be fed in smoothly and it is unnecessary to additionally dispose a narrower passage near the sewing point.

The above embodiment is only used to illustrate the present invention, not intended to limit the scope thereof. Many modifications of the above embodiment can be made without departing from the spirit of the present invention.

What is claimed is:

1. A device for manufacturing string core-free invisible zipper, comprising: a needle seat and a press tray disposed on a zipper making machine, wherein no zipper rack stretching/separating device is disposed in front of a zipper rack entrance of the needle seat and zipper racks on two sides are fed into the needle seat in a naturally loose state, wherein a surface of the needle seat has a pair of parallel guiding channels having first needle holes, a press tray disposed on the needle seat above the guiding channels and spaced therefrom by a predetermined distance for feeding fabric belt into the space therebetween, the press tray having second needle holes aligned with the first needle holes; and a cover board positioned between the press tray and the needle seat, a gap being defined between the cover board and the press tray for inputting fabric belt therein, passages between the guiding channels of the needle seat and the cover board for passing the zipper racks, a rear side of the cover board having a split aligned with the first and second needle holes.

2. The device as claimed in claim 1, further comprising a fixing seat disposed at a front end of the needle seat, and having a transverse beam with a partitioning plate at a center of the transverse beam for guiding fabric belts to be separately fed into the space between the press tray and the needle seat.

3. A device for manufacturing string core-free invisible zipper, comprising: a needle seat and a press tray disposed on a zipper making machine, wherein no zipper rack stretching/separating device is disposed in front of a zipper rack entrance of the needle seat and zipper racks on two sides are fed into the needle seat in a naturally loose state, wherein a surface of the needle seat has a pair of parallel guiding channels having first needle holes, a press tray disposed on the needle seat above the guiding channels and spaced therefrom by a predetermined distance for feeding fabric belt into the space therebetween, the press tray having second needle holes aligned with the first needle holes; and a fixing seat disposed at a front end of the needle seat, and having a transverse beam with a partitioning plate at a center of the transverse beam for guiding fabric belts to be separately fed into the space between the press tray and the needle seat.

* * * * *